US010415328B2

(12) United States Patent
Lutgring et al.

(10) Patent No.: US 10,415,328 B2
(45) Date of Patent: Sep. 17, 2019

(54) CLAMP-ON SINGLE JOINT MANIPULATOR FOR USE WITH SINGLE JOINT ELEVATOR

(71) Applicant: Frank's International, LLC, Houston, TX (US)

(72) Inventors: Keith Lutgring, Lafayette, LA (US); Logan Smith, Lafayette, LA (US); Nicholas Guidry, Breaux Bridge, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 303 days.

(21) Appl. No.: 15/254,149

(22) Filed: Sep. 1, 2016

(65) Prior Publication Data

US 2017/0370165 A1 Dec. 28, 2017

Related U.S. Application Data

(60) Provisional application No. 62/353,720, filed on Jun. 23, 2016.

(51) Int. Cl.

| | |
|---|---|
| ***E21B 19/00*** | (2006.01) |
| ***E21B 19/06*** | (2006.01) |
| ***E21B 19/16*** | (2006.01) |
| ***E21B 17/042*** | (2006.01) |
| ***E21B 19/087*** | (2006.01) |
| ***E21B 19/10*** | (2006.01) |
| ***E21B 19/02*** | (2006.01) |

(52) U.S. Cl.

CPC ..... *E21B 19/16* (2013.01); *E21B 17/042* (2013.01); *E21B 19/02* (2013.01); *E21B 19/06* (2013.01); *E21B 19/087* (2013.01); *E21B 19/10* (2013.01)

(58) Field of Classification Search

CPC . E21B 19/06; E21B 19/16; E21B 3/02; E21B 19/087; E21B 19/155; E21B 19/00

See application file for complete search history.

(56) References Cited

U.S. PATENT DOCUMENTS

| | | | | |
|---|---|---|---|---|
| 6,527,047 | B1 | 3/2003 | Pietras | |
| 6,920,926 | B2 | 7/2005 | York et al. | |
| 7,669,662 | B2 | 3/2010 | Pietras | |
| 8,127,836 | B1 * | 3/2012 | Keast | E21B 19/16 166/75.11 |
| 8,240,372 | B2 * | 8/2012 | Matherne, Jr. | E21B 3/02 166/379 |

(Continued)

FOREIGN PATENT DOCUMENTS

WO 2014-055516 A2 4/2014

OTHER PUBLICATIONS

Jin Ho Kim (Authorized Officer), International Search Report and Written Opinion dated Mar. 24, 2017, PCT Application No. PCT/US2016/049846, filed Sep. 1, 2016, pp. 1-21.

(Continued)

*Primary Examiner* — Kipp C Wallace

(74) *Attorney, Agent, or Firm* — MH2 Technology Law Group LLP

(57) ABSTRACT

An apparatus for assembling a tubular string includes a rig drilling bail, a joint bail extender, and a device. The joint bail extender is rigidly coupled to the rig drilling bail. The device is coupled to the first joint bail extender and configured to engage a tubular segment.

11 Claims, 12 Drawing Sheets

(56) References Cited

U.S. PATENT DOCUMENTS

| | | | | |
|---|---|---|---|---|
| 8,365,834 | B2 * | 2/2013 | Liess | E21B 19/16 166/382 |
| 8,757,277 | B2 * | 6/2014 | Dekker | E21B 19/166 166/380 |
| 2005/0098352 | A1 * | 5/2005 | Beierbach | E21B 19/06 175/57 |
| 2006/0027375 | A1 * | 2/2006 | Thomas, Jr. | E21B 3/04 166/380 |
| 2006/0191690 | A1 * | 8/2006 | Severin | E21B 19/06 166/379 |
| 2006/0249292 | A1 | 11/2006 | Guidry | |
| 2007/0251700 | A1 * | 11/2007 | Mason | E21B 19/06 166/379 |
| 2008/0060818 | A1 * | 3/2008 | Bourgeois | E21B 19/16 166/380 |
| 2008/0245575 | A1 | 10/2008 | Guidry | |
| 2009/0321064 | A1 | 12/2009 | Ellis et al. | |
| 2010/0183418 | A1 * | 7/2010 | Henderson | E21B 19/06 414/745.1 |
| 2010/0300704 | A1 * | 12/2010 | Sweeney | E21B 19/06 166/380 |
| 2012/0247786 | A1 | 10/2012 | Pietras et al. | |
| 2013/0075113 | A1 | 3/2013 | Pietras | |
| 2014/0090856 | A1 * | 4/2014 | Pratt | E21B 19/06 166/380 |

OTHER PUBLICATIONS

Author Unknown, Brochure for: ALCO Bail Extensions, ALCO, pp. 1-2.

Author Unknown, Brochure for: ALCO Adjustable Bail Extensions, ALCO, pp. 1-2.

Wittmann-Regis, Agnes (Authorized Officer), International Preliminary Report on Patentability dated Jan. 3, 2019, PCT Application No. PCT/US2016/049846, filed Sep. 1, 2016, pp. 1-14.

* cited by examiner

CLAMP-ON SINGLE JOINT MANIPULATOR FOR USE WITH SINGLE JOINT ELEVATOR

CROSS-REFERENCE TO RELATED APPLICATIONS

This application claims priority to U.S. Provisional Patent Application No. 62/353,720, filed on Jun. 23, 2016, the disclosure of which is incorporated by reference herein in its entirety.

BACKGROUND

A mechanical casing running tool ("CRT") is a multi-purpose casing running tool. Utilized on rigs equipped with top drives, CRTs are capable of casing-drilling and/or running. CRTs are available in various models from several manufacturers, but in combination with the top drive, they generally all perform the following functions: (1) makeup or breakout casing connections, (2) reciprocate casing strings, (3) fill casing strings with drilling fluid, (4) circulate drilling fluid through casing strings, and (5) rotate casing strings.

Without the convenience of a CRT to perform all of these operations, the multi-faceted process of casing-drilling and/or running typically requires a full complement of tools. In that sense, the use of a CRT can generally reduce cost, non-productive time ("NPT"), overall rig-time, and the number of safety hazards by eliminating the need to rig up and rig down multiple tools. Additionally, certain CRTs are equipped with pipe-pickup mechanisms that manipulate single joint elevators ("SJE"). By pivoting its pipe-pickup mechanism away from the well center (i.e., link-tilt), the CRT can utilize its SJE to latch onto a single joint of casing presented at the V-door. Then, by retracting the pipe-pickup mechanism as the top drive and CRT are hoisted into the derrick, the CRT can transport the single joint from the V-door to well center.

CRTs that are not equipped with pipe-pickup mechanisms, however, are incapable of retrieving single joints from the V-door. The lengths of these CRTs, once rigged up to the rig's top drive shaft, are such that the lower portions of the CRTs extend below the lower eyes of the rig bails that are used during drilling operations. Attaching a SJE to the rig bails, which are pivotally powered to reach out towards the rig's V-door, would be one way to retrieve single joints; however, attaching a SJE to the lower eyes of the rig bails results in interference between the CRT and the SJE, so this is not a feasible solution. In order to retrieve single joints from the V-door, it is common to utilize slings suspended from the top drive to attach a SJE. The process of rigging up, using, and rigging down pickup slings not only delays the job considerably, but it requires unsafe manual intervention to transport SJEs from well center to the V-door for every joint in the string, of which there may be several hundred. Some conventional bail extensions may be directly pinned to the rig bails, thereby eliminating the need to rig down the bails. However, there are serious disadvantages with this approach for picking up single joints. These bail extensions are rated for full string weight (e.g., 150-350 tons), which results in these extensions being heavy and expensive. Further, the pivoting connection of the extensions to the rig's drilling bails does not allow these bail extensions to reach the V-door in all cases. Although there are adjustable-length versions of these bail extensions, the same benefits and disadvantages apply.

Adjustable-length single joint links are also available. These single joint capacity elevator links are adjustable in length. The telescopic design allows the links to extend past the lower portion of the CRT, thereby providing an attachment point for a SJE and spanning the distance to the V-door. These adjustable-length single joint links are capable of being interfaced to the rig's link-tilt mechanism in the same manner as the drilling bails, thereby providing a means to manipulate these single joint links to pick up casing from the V-door. One drawback, however, is the fact that this product replaces rig bails, necessitating both the time-consuming, costly, dangerous rig down of the rig bails and the rather time-consuming rig up of these single joint links.

SUMMARY

An apparatus for assembling a tubular string is disclosed. The apparatus includes a rig drilling bail, a joint bail extender, and a device. The joint bail extender is rigidly coupled to the rig drilling bail. The device is coupled to the joint bail extender and configured to engage a tubular segment.

In another embodiment, the apparatus includes a top drive. A running tool is coupled to and positioned below the top drive. A rig drilling bail is also coupled to the top drive. A mechanism is coupled to the rig drilling bail. The mechanism is configured to move the rig drilling bail from a first, substantially non-vertical position to a second, substantially vertical position. A joint bail extender is rigidly coupled to the rig drilling bail. The joint bail extender is configured to move in unison with the rig drilling bail.

A method for assembling a tubular string is also disclosed. The method includes lifting a tubular segment using an assembly. The assembly includes a top drive. A rig drilling bail is coupled to the top drive. A joint bail extender is rigidly coupled to the rig drilling bail such that the joint bail extender does not pivot with respect to the rig drilling bail. A device is coupled to the joint bail extender. The tubular segment is engaged with the device when the tubular segment is lifted. A running tool is coupled to and positioned below the top drive. The rig drilling bail, the joint bail extender, and the device are in a first position when the tubular segment is lifted. A central axis through the rig drilling bail is oriented at an angle that is substantially perpendicular to a central axis through the running tool in the first position.

The foregoing summary is intended merely to introduce a subset of the features more fully described of the following detailed description. Accordingly, this summary should not be considered limiting.

BRIEF DESCRIPTION OF THE DRAWINGS

The accompanying drawings, which are incorporated in and constitute a part of this specification, illustrate an embodiment of the present teachings and together with the description, serve to explain the principles of the present teachings. In the figures.

Figure 1:
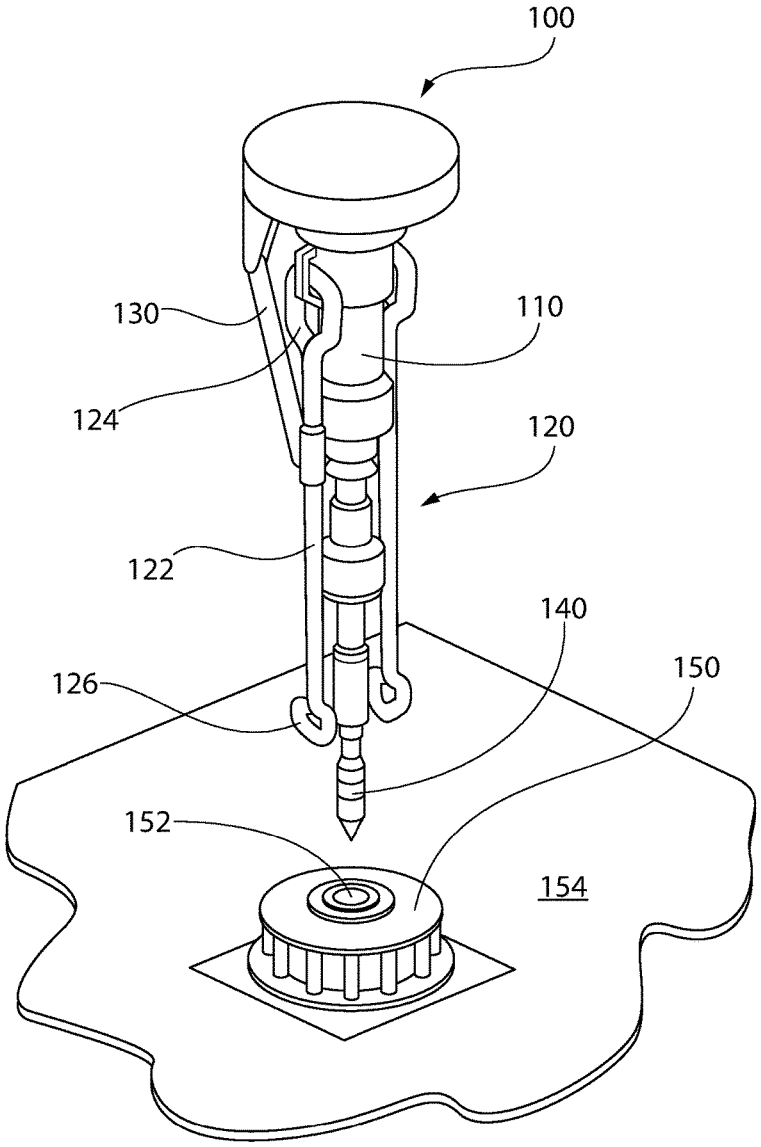
FIG. 1 illustrates an isometric view of a portion of an apparatus for assembling a tubular string, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

The apparatus disclosed may pick up single joints of casing utilizing a top drive and a CRT that is not equipped with a pipe-pickup mechanism. The apparatus requires only a minimum of equipment rig-up. This is accomplished by attaching adjustable bail extenders to the rig drilling bails, thereby lengthening the rig drilling bails past the lower portion of the CRT and providing an attachment point for an SJE. Using the rig's link-tilt, the driller can now easily reach the V-door and retrieve a single joint with the SJE.

FIG. 1 illustrates an isometric view of a portion of an apparatus 100 for assembling a tubular string, according to an embodiment. The apparatus 100 may include a top drive 110. The top drive 110 may be configured to rotate a tubular string (e.g., drill string, casing string, production tubing, etc.) or segments thereof (referred to as "joints").

One or more rig drilling bails (two are shown: 120) may be coupled to and extend downward from the top drive 110. Each of the rig drilling bails 120 may include a shaft 122 with loops (e.g., eyes) 124, 126 positioned at each end thereof. The first, upper loops 124 may be used to couple the rig drilling bails 120 to the top drive 110. The second, lower loops 126 may be positioned below the lower end of the top drive 110.

Figure 5:
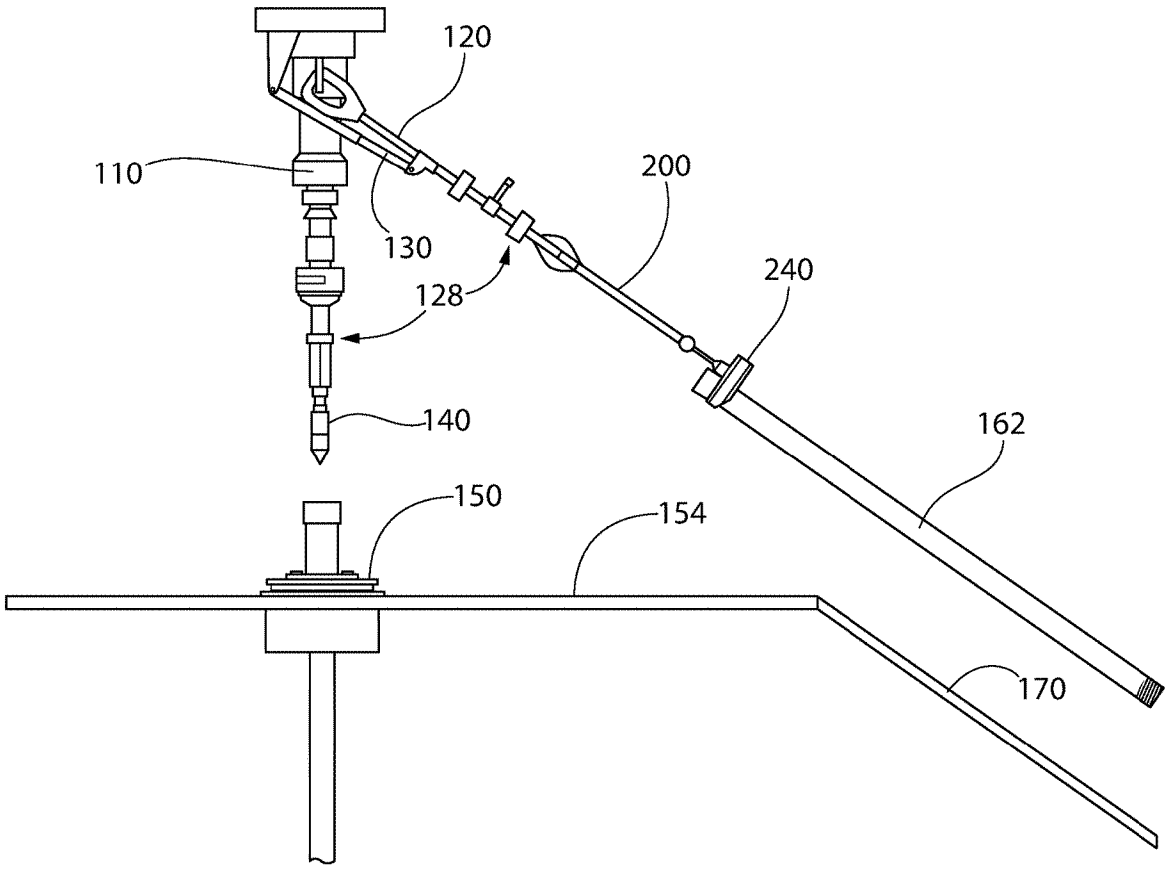
FIG. 5 illustrates a schematic side view of the apparatus lifting an add-on tubular segment out of a V-door, according to an embodiment.

One or more rig link-tilt mechanisms (two are shown: 130) may be coupled to the rig drilling bails 120. The rig link-tilt mechanisms 130 may be configured to tilt the rig drilling bails 120 from a first position (e.g., inclined or substantially horizontal), as shown in FIG. 5, to a second position (e.g., substantially vertical), as shown in FIG. 1. More particularly, the rig link-tilt mechanisms 130 may be configured to cause the rig drilling bails 120 to pivot about the upper loops 124 such that the shafts 122 and the lower loops 126 sweep through an arcuate path.

A casing running tool ("CRT") 140 may be coupled to and positioned below the top drive 110. The CRT 140 may be positioned laterally-between the rig drilling bails 120. A lower end of the CRT 140 may extend below the rig drilling bails 120 (e.g., below the second, lower loops 126). Although the CRT 140 is shown and described herein, it will be appreciated other running tools may alternatively be used to run tubular segments and/or strings other than casing such as, for example, drill pipe, production tubing, liner, etc. In at least one embodiment, the CRT 140 may not be configured to pick up an add-on tubular segment 162 from a V-door 170.

A spider 150 may be positioned on the rig floor 154. The spider 150 may be positioned below the top drive 110, the rig drilling bails 120, and the CRT 140. The CRT 140 may be aligned with a vertical bore 152 formed through the spider 150. The spider 150 may include one or more retractable slips that are configured to engage and support an uppermost segment of a tubular string.

Figure 2:
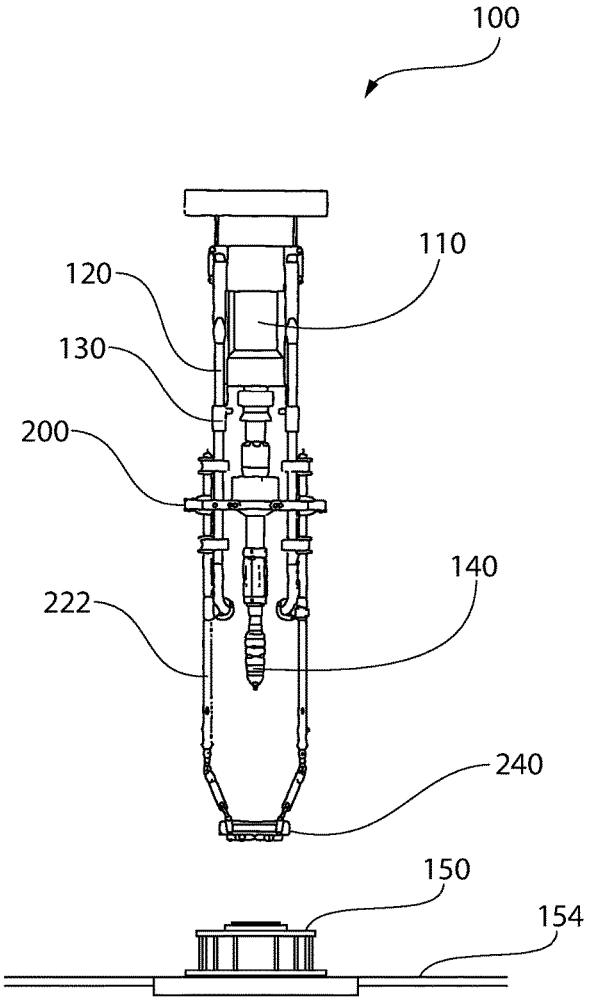
FIG. 2 illustrates a frontal view of the apparatus including two joint bail extenders, according to an embodiment.

FIG. 2 illustrates a frontal view of the apparatus 100 including two joint bail extenders 200, according to an embodiment. The joint bail extenders 200 may be coupled to and extend downward from the rig drilling bails 120. The joint bail extenders 200 may be parallel to one another. As shown, a lower end 222 of the joint bail extenders 200 may be positioned below the rig drilling bails 120 (e.g., below the lower loops 126) and below the CRT 140.

A single joint elevator ("SJE") 240 may be coupled to the joint bail extenders 200 proximate to the lower ends 222 thereof. Although the SJE 240 is shown and described herein, it will be appreciated other devices may alternatively be used to engage and move tubular segments. In contrast to some conventional apparatuses, the SJE (or other device for engaging tubular segments) may not be coupled to the CRT 140.

Figure 3:
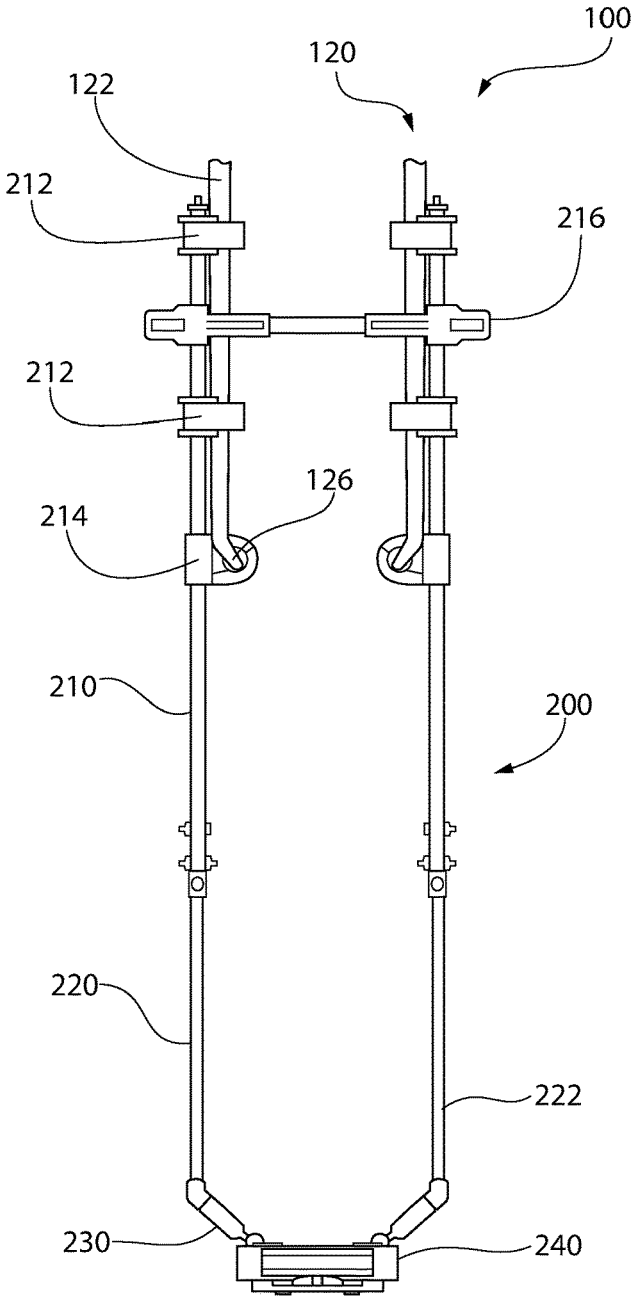
FIG. 3 illustrates an enlarged frontal view of the apparatus showing the two joint bail extenders, according to an embodiment.

FIG. 3 illustrates an enlarged frontal view of the apparatus 100 showing the two joint bail extenders 200, according to an embodiment. Each joint bail extender 200 may include one or more axial segments (referred to herein as "booms"). As shown, each joint bail extender 200 includes a first, upper boom 210 and a second, lower boom 220.

The upper boom 210 of each joint bail extender 200 may include one or more first connectors (e.g., removable bail clamps) 212 that are configured to couple the upper boom 210 to the shaft 122 of the corresponding rig drilling bail 120. The upper boom 210 of each joint bail extender 200 includes two first connectors 212 that are axially-offset from one another. The upper boom 210 of each joint bail extender 200 may also include a second connector (e.g., a lifting ear) 214 that is configured to couple the upper boom 210 to the lower loop 126 of the corresponding rig drilling bail 120. The first and second connectors 212, 214, which may accommodate different rig drilling bail sizes, not only withstand axial loads associated with lifting joints of casing, but they create a rigid, non-pivoting connection to prevent the joint bail extender 200 from pivoting at the interface with the lower loop 126 of the rig drilling bail 120. In combination with the integral lifting ears, these connectors 212, 214 create a connection between the joint bail extender 200 and the rig drilling bail 120 that can support the combined weight of the SJE 240 and casing joint in either a tilted or vertical configuration. Once the upper boom 210 is secured to the rig drilling bail 120, the lower boom 220 can be adjusted so that the SJE 240 is positioned correctly over the V-door 170 to grip the add-on tubular segment 162.

A crossbar 216 may extend laterally-between and couple the upper booms 210 of the two joint bail extenders 200 together. The crossbar 216 may be disposed between the upper booms 210 to facilitate the stabilization and alignment of the rig drilling bails 120. Additionally, by way of pins and secondary retention means, the crossbar's adjustable design may establish various set distances between the rig drilling bails 120 to accommodate various CRTs 140, top drives 110, and SJEs 240. The joint bail extender 200 may be easily and quickly attached directly to the rig drilling bail 120, unlike conventional alternatives that require rigging down the rig drilling bails 120 to rig up adjustable length single joint links.

As may be seen, the connection(s) between each joint bail extender 200 and the corresponding rig drilling bail 120 may be a rigid (i.e., non-pivoting) connection. In other words, the joint bail extender 200 may not be able to pivot or rotate with respect to the corresponding rig drilling bail 120. As a result, the joint bail extender 200 may remain substantially aligned with the corresponding rig drilling bail 120, even when the rig drilling bail 120 and joint bail extender 200 are tilted to pivot the joint bail extender 200 out to the V-door 170 to pick up an add-on tubular segment 162.

The lower boom 220 of each joint bail extender 200 may be configured to extend and retract (e.g., telescope) with respect to the corresponding upper boom 210 to vary the length of the joint bail extender 200. A pivot link 230 may be coupled to the lower end 222 of each lower boom 220, and the pivot link 230 may couple the lower boom 220 to the SJE 240.

Figure 4A:
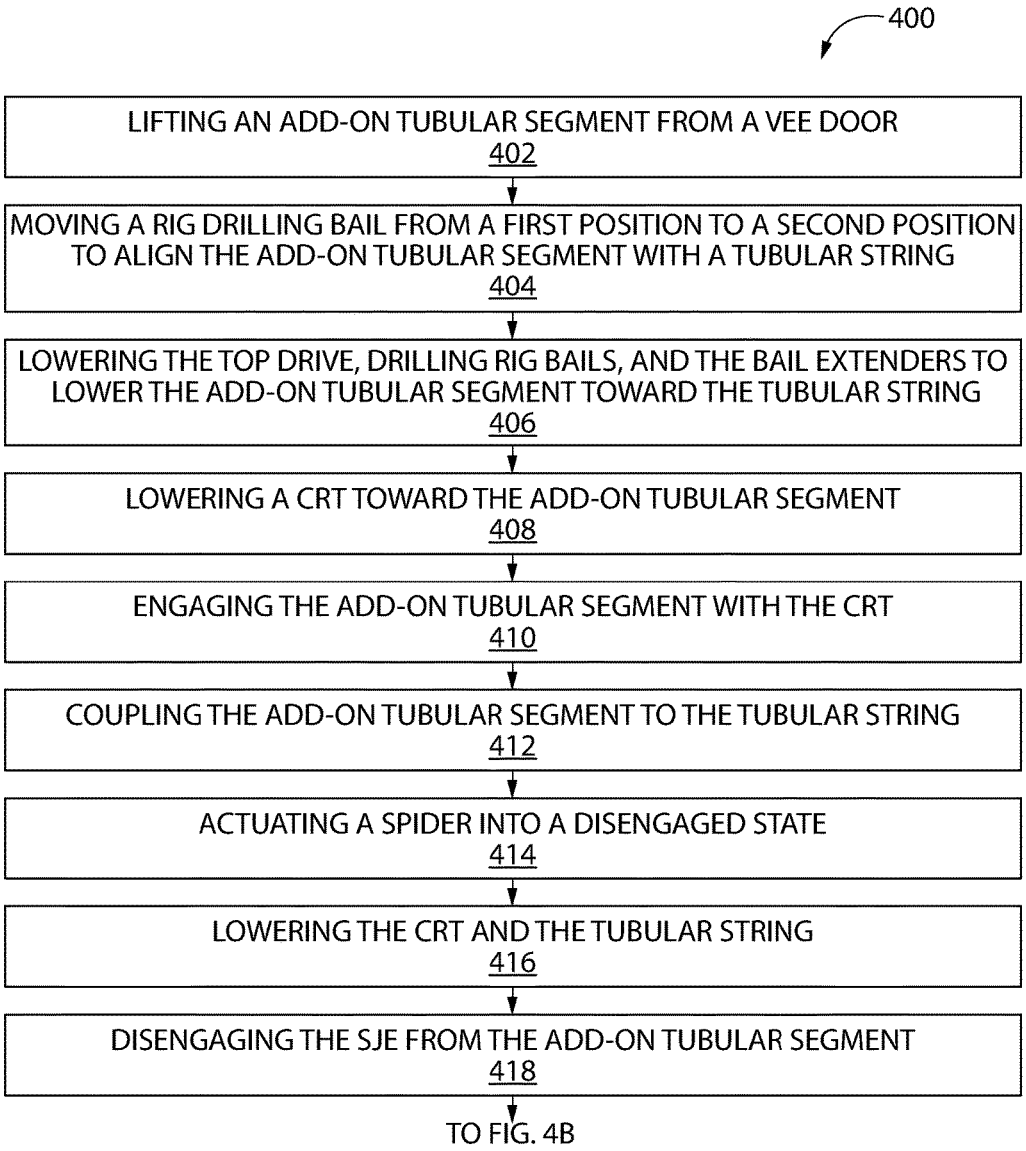
FIGS. 4A and 4B illustrate a flowchart of a method for assembling a tubular string, according to an embodiment.
Figure 4B:
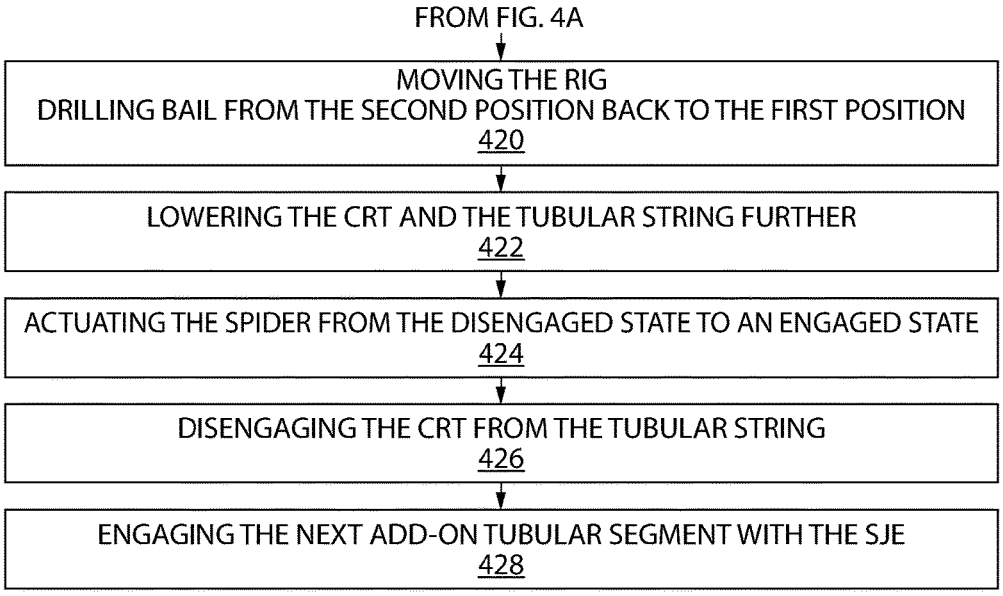
Figure 10:
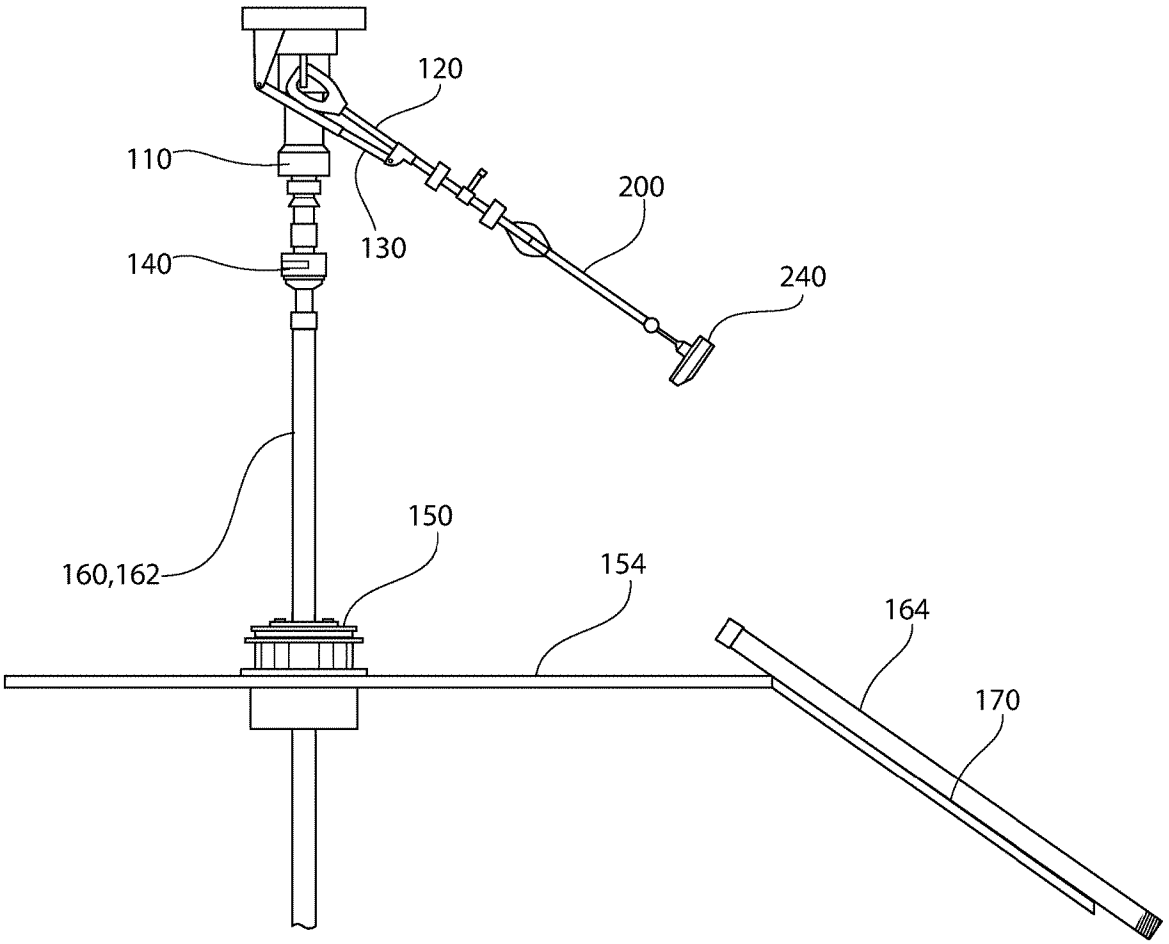
FIG. 10 illustrates a schematic side view of the rig drilling bails, the joint bail extenders, and the SJE actuated into an inclined position, according to an embodiment.
Figure 11:
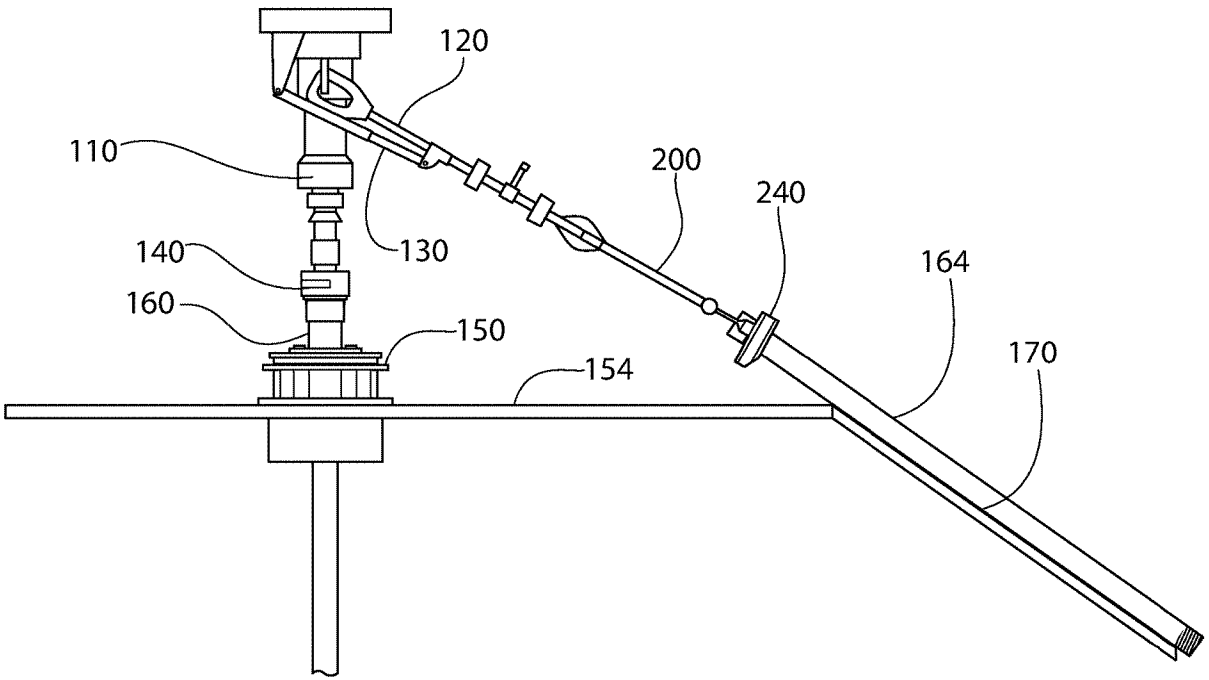
FIG. 11 illustrates a schematic side view of the top drive and the CRT lowering the tubular string further with respect to the spider, according to an embodiment.

FIG. 4 illustrates a flowchart of a method 400 for assembling a tubular string 160, according to an embodiment. The method 400 may be viewed together with FIGS. 5-11, which illustrate various steps of the method 400. To better illustrate the method 400, FIGS. 5, 10, and 11 are illustrated from a side viewpoint, and FIGS. 6-9 are illustrated from a frontal viewpoint that is offset by 90° from the side viewpoint.

As illustrated in FIG. 5, the method 400 may include lifting an add-on tubular segment 162 from a V-door 170, as at 402. As shown, the add-on tubular segment 162 may be engaged with the SJE 240, and upward movement of the top drive 110 may lift the rig drilling bails 120 (and the joint bail extenders 200, the SJE 240, and the add-on tubular segment 162 coupled thereto). The rig drilling bails 120 (and the joint bail extenders 200 and SJE 240 coupled thereto) may be in a first position as the add-on tubular segment 162 is lifted. The first position may be inclined/tilted with respect to vertical. When in the first position, a central longitudinal axis through the rig drilling bails 120 (and the joint bail extenders 200, the SJE 240, and the add-on tubular segment 162 coupled thereto) may be at an angle 128 from about 0° to about 90° with respect to a central longitudinal axis through the CRT 140 (e.g., with respect to vertical).

Figure 6:
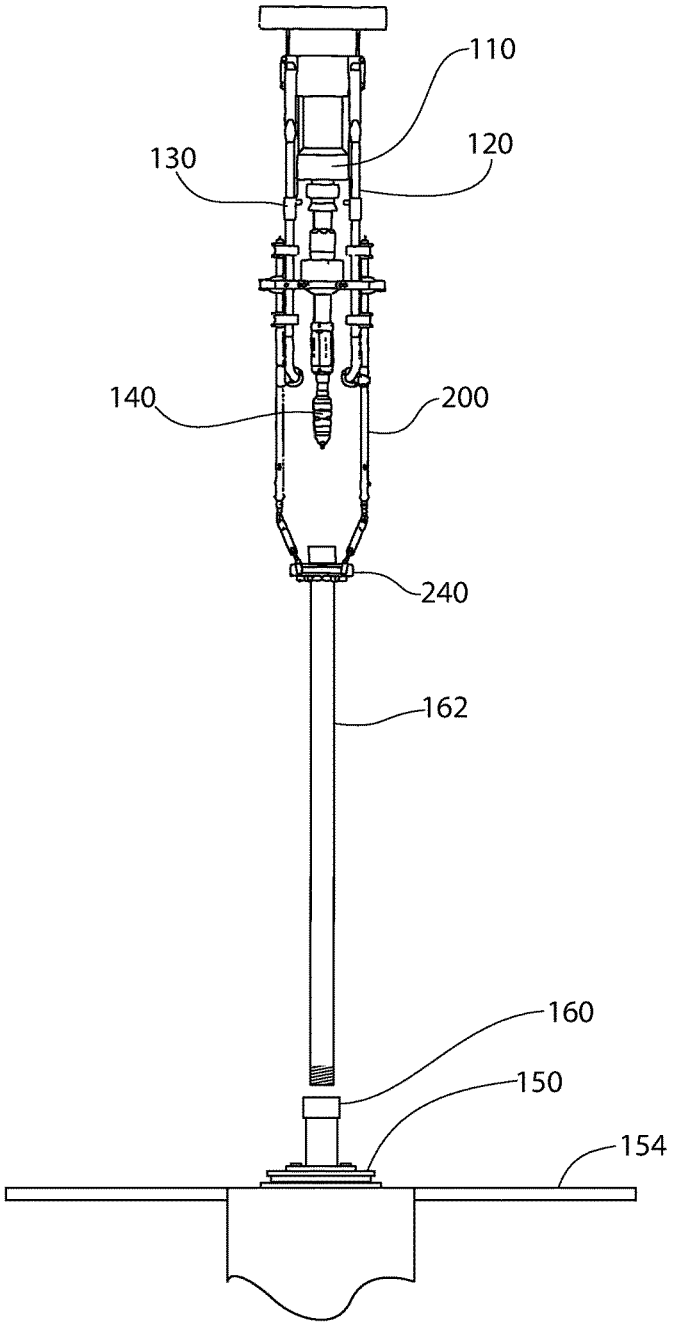
FIG. 6 illustrates a schematic frontal view of the apparatus aligning the add-on tubular segment with a tubular string that is supported by a spider, according to an embodiment.

As illustrated in FIG. 6, once the add-on tubular segment 162 has been lifted at least partially from the V-door 170, the method 400 may include moving (e.g., pivoting) the rig drilling bails 120 (and the joint bail extenders 200 and SJE 240 coupled thereto) from the first position into a second position using the rig link-tilt mechanisms 130, as at 404. When in the second position, the central longitudinal axis through the rig drilling bails 120 (and the joint bail extenders 200, the SJE 240, and the add-on tubular segment 162 coupled thereto) may be substantially vertical. As a result, the add-on tubular segment 162 may be positioned above and aligned with the tubular string 160 and the spider 150.

Figure 7:
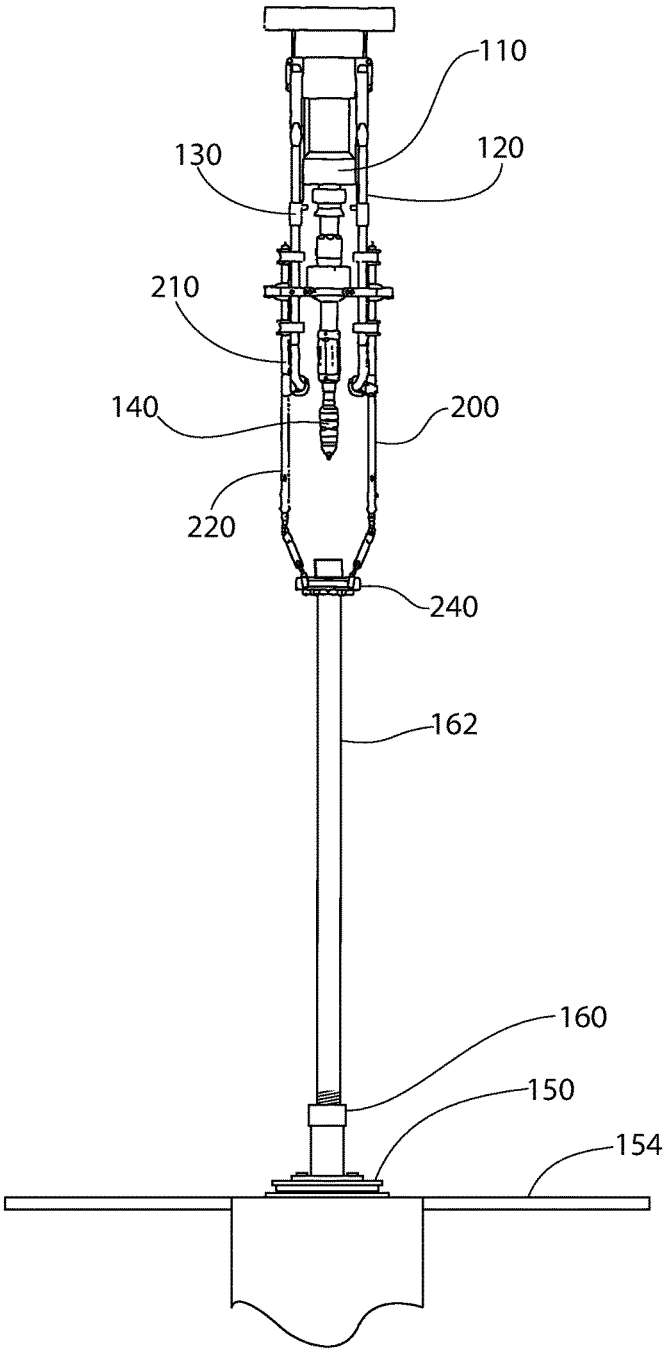
FIG. 7 illustrates a schematic frontal view of the joint bail extenders lowering the add-on tubular segment toward the tubular string, according to an embodiment.

As shown in FIG. 7, the method 400 may also include lowering the add-on tubular segment 162 toward the tubular string 160, as at 406. The top drive 110, rig drilling bails 120, and joint bail extenders 200 may be lowered in order to lower the add-on tubular segment 162 toward the tubular string 160. In one example, the add-on tubular segment 162 may be lowered until a pin connection at the lower end of the add-on tubular segment 162 is inserted at least partially into a box connection in the upper end of the tubular string 160.

Figure 8:
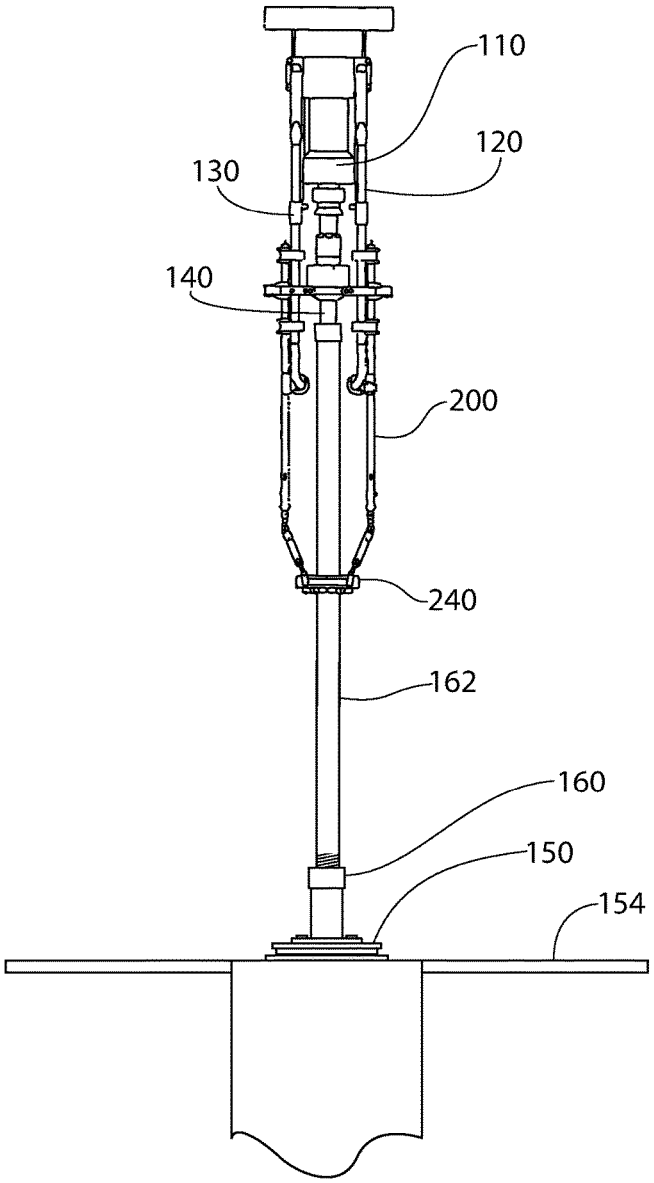
FIG. 8 illustrates a schematic frontal view of a top drive and a CRT being lowered such that the CRT is inserted at least partially into and engages the add-on tubular segment, according to an embodiment.

As shown in FIG. 8, the method 400 may also include lowering the CRT 140 toward the add-on tubular segment 162, as at 408. For example, the CRT 140 may be lowered until it is inserted at least partially into an upper end of the add-on tubular segment 162. The CRT 140 may be lowered after the add-on tubular segment 162 is lowered into contact with the tubular string 160; however, in other embodiments, the CRT 140 may be lowered simultaneously with the add-on tubular segment 162.

The method 400 may also include engaging the add-on tubular segment 162 with the CRT 140 after the CRT 140 is inserted therein, as at 410. The CRT 140 may be configured to support the weight of the add-on tubular segment 162 (and subsequently the entire tubular string 160) when engaged therewith. By engaging the add-on tubular segment 162 with the CRT 140 prior to coupling the add-on tubular segment 162 to the tubular string 160, as discussed below, the joint bail extenders 200 do not have to support the full weight of the tubular string 160. Rather, the joint bail extenders 200 are only supporting a single add-on tubular segment 162 at a time. Thus, the joint bail extenders 200 may be rated for a single add-on tubular segment 162 (e.g., about 10 tons) rather than the weight of the full tubular string 160. As a result, the joint bail extenders 200 may be lighter weight and less expensive than conventional alternatives.

The method 400 may also include rotating the add-on tubular segment 162 with respect to the tubular string 160, as at 412. The add-on tubular segment 162 may be rotated using the top drive 110 and/or the CRT 140. The rotation of the on add-on tubular segment 162 with respect to the tubular string 160 may couple or "make-up" the add-on tubular segment 162 to the tubular string 160, such that the add-on tubular segment 162 becomes a part of the tubular string 160.

The method 400 may also include actuating the spider 150 from an engaged state to a disengaged state, as at 414. The spider 150 may be actuated from the engaged state to the disengaged state after the add-on tubular segment 162 becomes a part of the tubular string 160. The slips of the spider 150 may contact and support the tubular string 160 when the spider 150 is in the engaged state, and the slips of the spider 150 may be spaced apart from the tubular string 160 such that the spider does not support the tubular string 160 when the spider 150 is in the disengaged state.

Figure 9:
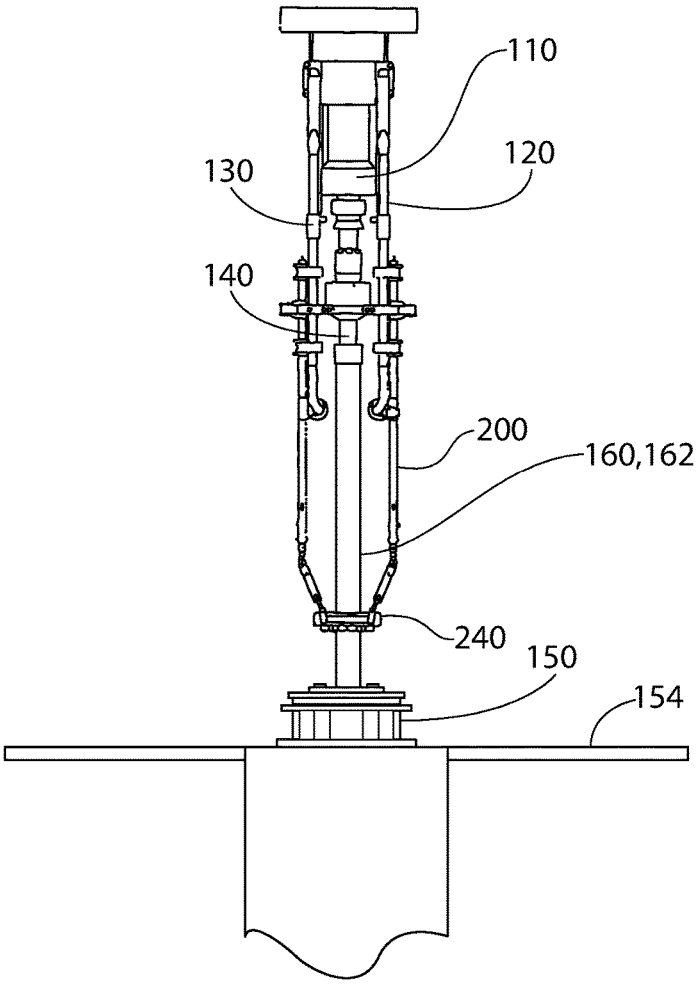
FIG. 9 illustrates a schematic frontal view of the top drive and the CRT lowering the tubular string with respect to the spider, according to an embodiment.

As shown in FIG. 9, the method 400 may also include lowering the CRT 140 and the tubular string 160 (which now includes the add-on tubular segment 162) with respect to the spider 150, as at 416. More particularly, the tubular string 160 may be lowered by lowering the top drive 110 and/or the CRT 140. The tubular string 160 may be lowered until the SJE 240 is a predetermined distance above the spider 150. The predetermined distance may be from about 2 feet to about 5 feet. Once the SJE 240 is positioned within the predetermined distance above the spider 150, the method 400 may also include disengaging the SJE 240 from the tubular string 160, as at 418.

As shown in FIG. 10, once the SJE 240 is disengaged from the tubular string 160, the method 400 may include moving (e.g., tilting) the rig drilling bails 120 (and the joint bail extenders 200 and SJE 240 coupled thereto) from the second (e.g., vertical) position back to the first (e.g., inclined/tilted) position using the rig link-tilt mechanisms 130, as at 420. The CRT 140 may remain positioned at least partially within and coupled to the tubular string 160 as the drilling bails 120 (and the joint bail extenders 200 and SJE 240 coupled thereto) are moved from the second position back to the first position.

As shown in FIG. 11, once the drilling bails 120 (and the joint bail extenders 200 and SJE 240 coupled thereto) have been moved from the second position back to the first position, the method 400 may include lowering CRT 140 and the tubular string 160 further with respect to the spider 150, as at 422. The tubular string 160 may be lowered until the upper end of the tubular string 160 is a predetermined distance above the spider 150. The predetermined distance may be from about 2 feet to about 5 feet. The rig drilling bails 120 (and the joint bail extenders 200 and the SJE 240 coupled thereto) may be lowered simultaneously with the CRT 140 and the tubular string 160. For example, the rig drilling bails 120 (and the joint bail extenders 200 and the SJE 240 coupled thereto) may substantially aligned with a next add-on tubular segment 164 positioned in the V-door 170 when the upper end of the tubular string 160 is the predetermined distance above the spider 150.

Once the upper end of the tubular string 160 is at the predetermined distance above the spider 150, the method 400 may include actuating the spider 150 from the disengaged state to the engaged state, as at 424. As mentioned above, the spider 150 may contact and support the tubular string 160 when the spider 150 is in the engaged state. Once the spider 150 has engaged the tubular string 160, the method 400 may include disengaging the CRT 140 from the tubular string 160, as at 426. The method 400 may also include engaging the next add-on tubular segment 164 with the SJE 240, as at 428. The method 400 may then loop back to 402 and begin again.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for assembling a tubular string, comprising:

a rig drilling bail comprising an upper eye and a lower eye;

a first bail extender rigidly coupled to the lower eye of the rig drilling bail, such that the first bail extender is restrained from moving with respect to the rig drilling bail; and a device coupled to the first bail extender and configured to engage a tubular segment.

2. The apparatus of claim 1, wherein the first bail extender comprises an upper boom and a lower boom, wherein the upper boom is rigidly coupled to the rig drilling bail such that the upper boom does not pivot with respect to the rig drilling bail, and wherein the lower boom is configured to extend and retract with respect to the upper boom to provide length adjustment of the first bail extender.

3. The apparatus of claim 2, wherein the first bail extender comprises a first connector coupled to the lower eye.

4. The apparatus of claim 3, wherein the upper boom of the first bail extender comprises a second connector coupled to the rig drilling bail above the lower eye.

5. The apparatus of claim 4, further comprising:

a second bail extender that is substantially parallel to the first bail extender; and a cross bar coupled to and extending between the first and second bail extenders, wherein the cross bar is configured to extend in length.

6. The apparatus of claim 1, wherein the lower eye comprises a loop, wherein the upper eye comprises a loop, wherein rig drilling bail comprises a shaft extending between and formed integrally with the upper and lower eyes.

7. An apparatus for assembling a tubular string, comprising:

a top drive;

a running tool coupled to and positioned below the top drive;

a rig drilling bail comprising an upper eye coupled to the top drive and a lower eye;

a mechanism coupled to the rig drilling bail that is configured to move the rig drilling bail from a first, substantially non-vertical position to a second, substantially vertical position; and a bail extender rigidly coupled to the lower eye of the rig drilling bail such that the bail extender is held stationary with respect to the rig drilling bail, wherein the bail extender is configured to move in unison with the rig drilling bail.

8. The apparatus of claim 7, wherein a lower end of the running tool extends below a lower end of the rig drilling bail, and wherein a lower end of the bail extender is positioned below the lower end of the running tool.

9. The apparatus of claim 8, wherein the bail extender is substantially aligned with the rig drilling bail in the first and second positions.

10. The apparatus of claim 9, wherein the bail extender comprises an upper boom and a lower boom, wherein the upper boom is rigidly coupled to the rig drilling bail such that the upper boom does not pivot with respect to the rig drilling bail, and wherein the lower boom is configured to extend and retract with respect to the upper boom to provide length adjustment of the bail extender.

11. The apparatus of claim 10, wherein the upper eye of the rig drilling bail is coupled to the top drive, and wherein the mechanism is coupled to the rig drilling bail between the upper and lower eyes.

* * * * *